US008858170B2

(12) United States Patent
Pedersen

(10) Patent No.: US 8,858,170 B2
(45) Date of Patent: Oct. 14, 2014

(54) CENTRIFUGAL PUMP ASSEMBLY

(75) Inventor: Nicholas Pedersen, Randers NØ (DK)

(73) Assignee: Grundfos Management A/S, Bjerringbro (DK)

( * ) Notice: Subject to any disclaimer, the term of this patent is extended or adjusted under 35 U.S.C. 154(b) by 650 days.

(21) Appl. No.: 13/122,236

(22) PCT Filed: Aug. 6, 2009

(86) PCT No.: PCT/EP2009/005681

§ 371 (c)(1),
(2), (4) Date: May 11, 2011

(87) PCT Pub. No.: WO2010/037444

PCT Pub. Date: Apr. 8, 2010

(65) Prior Publication Data

US 2012/0128478 A1 May 24, 2012

(30) Foreign Application Priority Data

Oct. 1, 2008 (EP) ..... 08017263

(51) Int. Cl.
*F04D 29/54* (2006.01)
*F04D 15/00* (2006.01)
*F04D 29/44* (2006.01)

(52) U.S. Cl.
CPC ..... *F04D 15/0088* (2013.01); *F04D 29/445* (2013.01)
USPC ..... 415/203; 415/118; 138/39; 73/861.22

(58) Field of Classification Search
USPC ..... 73/168; 415/118, 182.1, 203, 206, 415/208.1, 212.1; 138/39, 37
See application file for complete search history.

(56) References Cited

U.S. PATENT DOCUMENTS

| | | | | | |
|---|---|---|---|---|---|
| 1,657,891 | A | * | 1/1928 | Miller | 48/189.4 |
| 1,683,089 | A | * | 9/1928 | Mills | 48/189.4 |
| 1,778,790 | A | * | 10/1930 | Brandl et al. | 48/189.4 |
| 2,615,301 | A | * | 10/1952 | Smith | 60/804 |
| 4,418,578 | A | | 12/1983 | Blechinger | |
| 4,455,877 | A | | 6/1984 | Blechinger et al. | |

(Continued)

FOREIGN PATENT DOCUMENTS

| | | | |
|---|---|---|---|
| CN | 1115011 | A | 1/1996 |
| CN | 1168467 | A | 12/1997 |

(Continued)

OTHER PUBLICATIONS

Office Action issued May 6, 2013 in CN Application No. 200980148331.7.

(Continued)

*Primary Examiner* — Ned Landrum
*Assistant Examiner* — Alexander White
(74) *Attorney, Agent, or Firm* — Panitch Schwarze Belisario & Nadel LLP

(57) ABSTRACT

The invention relates to a centrifugal pump assembly with at least one impeller, with a suction union, which is situated on the entry side of the impeller, and with a pressure union, which is situated on the exit side of the impeller. A flow sensor and at least one guidance element are arranged in a conduit section, which is formed by the suction union and/or by the pressure union. The guidance element is suitable for influencing the flow prevailing in the conduit section.

14 Claims, 5 Drawing Sheets

(56) References Cited

U.S. PATENT DOCUMENTS

Figure 1:
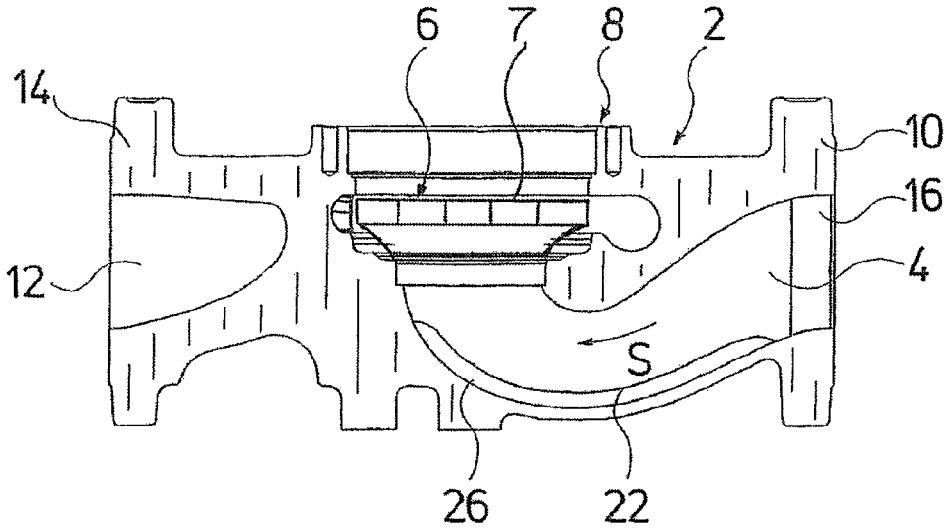

| | | | | |
|---|---|---|---|---|
| 5,129,264 | A | 7/1992 | Lorenc | |
| 5,257,901 | A | 11/1993 | Malchow | |
| 5,297,930 | A * | 3/1994 | Moore | 415/182.1 |
| 5,483,791 | A * | 1/1996 | Kotwal et al. | 60/796 |
| 5,618,160 | A | 4/1997 | Harada et al. | |
| 6,273,677 | B1 * | 8/2001 | Wang et al. | 415/191 |
| 6,729,843 | B1 * | 5/2004 | Nichtawitz et al. | 415/211.2 |
| 6,981,838 | B2 * | 1/2006 | McKee et al. | 415/1 |
| 7,021,336 | B2 * | 4/2006 | Burrows et al. | 138/39 |
| 7,048,035 | B2 * | 5/2006 | Farag | 165/42 |
| 7,513,273 | B2 * | 4/2009 | Bivin | 138/37 |
| 7,603,914 | B2 * | 10/2009 | Hoecker | 73/861.22 |
| 2005/0145041 | A1 * | 7/2005 | Koudal et al. | 73/861.22 |
| 2005/0254941 | A1 * | 11/2005 | Inoue et al. | 415/182.1 |
| 2007/0009352 | A1 * | 1/2007 | Faile et al. | 415/203 |
| 2007/0220994 | A1 * | 9/2007 | Keese et al. | 73/861.22 |
| 2008/0121301 | A1 * | 5/2008 | Norris | 138/39 |
| 2008/0141785 | A1 * | 6/2008 | Wang et al. | 73/861.22 |
| 2008/0181771 | A1 * | 7/2008 | Papp | 415/208.1 |
| 2008/0210325 | A1 * | 9/2008 | Aroussi | 138/39 |
| 2008/0232950 | A1 * | 9/2008 | Stabley et al. | 415/1 |
| 2008/0307894 | A1 * | 12/2008 | Nuber et al. | 73/861.24 |
| 2009/0301219 | A1 * | 12/2009 | Oda et al. | 73/861.22 |
| 2010/0018323 | A1 * | 1/2010 | Cheng et al. | 73/861.24 |

FOREIGN PATENT DOCUMENTS

| | | | | |
|---|---|---|---|---|
| CN | 1714278 | A | 12/2005 | |
| DE | 9317856 | U1 | 1/1994 | |
| DE | 19647967 | A1 | 5/1998 | |
| DE | 10249129 | A1 | 6/2004 | |
| EP | 597440 | A1 * | 5/1994 | F04D 27/02 |
| EP | 1413768 | B1 | 10/2005 | |
| GB | 2057569 | A | 4/1981 | |
| JP | 57198379 | A | 12/1982 | |
| JP | 05263782 | A * | 10/1993 | F04D 15/00 |

OTHER PUBLICATIONS

Int'l. Search Report issued on Nov. 6, 2009 in Int'l. Application No. PCT/EP2009/005681.

* cited by examiner

CENTRIFUGAL PUMP ASSEMBLY

The invention relates to a centrifugal pump assembly with at least one impeller, a suction union situated on the entry side of the at least one impeller and a pressure union situated on the exit side of the at least one impeller.

Such centrifugal pump assemblies are applied for example as heating circulation pumps. Such pumps are applied in numbers of installations in which the throughput through the conduits is also determined, in order to be taken into account with the control and/or regulation (closed-loop control). This is the case for example in heating installations, in which the throughput through the pump or an adjacent pipe conduit is determined. For this, flow sensors are arranged in the pipe conduits.

It is the object of the invention, to simplify the arrangement of a pump assembly and of a flow sensor. This object is achieved by a centrifugal pump assembly with at least one impeller with a suction union situated on an entry side of the at least one impeller and a pressure union situated on an exit side of the at least one impeller. A flow sensor and at least one guidance element are arranged in a conduit section formed by the suction union or the pressure union. The at least one guidance element is suitable for influencing a flow prevailing in the conduit section. Preferred embodiments are to be deduced from the dependent claims, the subsequent description as well as the figures.

The centrifugal pump assembly according to the invention, in the known manner, comprises at least one impeller and a suction union which is located on the entry side of the impeller, and a pressure union which is arranged on the exit side of the impeller. The suction union and pressure union end at their free ends, which are distant to the impeller, preferably in a flange in the known manner, which permits a connection to adjacent pipe conduits.

According to the invention, a flow sensor is integrated into this centrifugal pump assembly. The flow sensor is arranged in a conduit section of the centrifugal pump assembly. This may be a conduit section in the suction union or a conduit section in the pressure union. Alternatively, it is also possible to arrange a flow sensor in each case in the pressure union as well as in the suction union.

Since turbulences in the flow arise in the suction union and pressure union of a centrifugal pump assembly, which are caused by the impeller, the flow measurement with known flow sensors is not possible without further ado in the regions of the suction union and pressure union. Usually, a certain minimum distance between the impeller and the flow sensor must be maintained, which is not available in a pump assembly of the normal construction type. For this reason, according to the invention, at least one guidance element is provided, which is arranged in the conduit section in which the flow sensor is also arranged. Thereby, the guidance element is suitable for influencing the flow prevailing in the conduit section. Thus the guidance element may influence the flow such that the reading of the flow sensor is not, or is only insignificantly influenced by the turbulences in the suction union or pressure union. The guidance element is thus preferably designed such that it keeps disturbing turbulences away from the flow sensor.

This is particularly advantageous, if, with regard to the flow sensor, as is preferred, it is the case of a vortex flow sensor. With such a flow sensor, an obstruction is arranged in the flow, which causes vortices in the flow, which are then detected with regard to measurement technology by way of a pressure sensor. The flow speed may be determined from the frequency of the vortices. It is to be understood that such a sensor would be greatly compromised with regard to the measurement result due to turbulences or eddies in the flow. For this reason, the guidance element according to the invention is provided, which influences the flow in the conduit section, in which the sensor is arranged, in a manner such that disturbing turbulences or eddies which could adulterate or compromise the measurement result, are kept away from the sensor.

The at least one guidance element is thus preferably suitable for calming the flow which prevails in the conduit section, in which the flow sensor is arranged. Thus, in particular in the region of a vortex flow sensor, ideally only those vortices occur, which are caused by its obstruction, but not those turbulences or eddies, which originate from the operation of the impeller.

According to a preferred embodiment, the at least one guidance element is designed as a rib projecting inwards from the inner wall of the conduit section. Such a rib is particularly suitable for damping or preventing rotating flows in the conduit section, since such a rib opposes such a flow. In the case that the conduit section of the suction union and/or the pressure union runs in a curved manner, such a rib is arranged on the inner wall of the conduit section, preferably on the outer side of the curvature, i.e. on a concavely curved inner wall or on the inner wall with a larger radius of curvature.

Particularly preferably, the rib is designed in a manner such that it extends in the flow direction of a fluid to be delivered, along the inner wall of the conduit section. Thus the flow which flows in the flow direction parallel to the longitudinal axis of the conduit section is influenced very little by the rib, but the rib offers a significant resistance to rotary flows, so that such flows or turbulences in the conduit section are damped or suppressed. In this manner, disturbances which compromise the measurement result of the flow sensor are reduced.

In the case that the flow sensor is arranged in the suction union, the rib extends preferably between the flow sensor and the impeller. In the case that a vortex flow sensor is provided, the rib, preferably proceeding from the obstruction of the sensor, extends preferably up to and into, a curvature region of the suction union. Such a rib may be designed as one piece on the inner wall of the conduit section, or be inserted into the conduit section as a separate component. Thus the rib may be designed as an insert or part of an insert, which is inserted into the conduit section, for example the suction union. Such an insert may be designed of plastic preferably.

It is further preferable for a measurement probe of the flow sensor to be arranged in the rib. This is particularly the case if the sensor is designed as a vortex flow sensor. In this case, the pressure sensor, which detects vortices caused by the obstruction, may be arranged in the rib. In this manner, the flow resistance in the conduit section, which is caused by the rib and the pressure sensor, is minimised.

Preferably, the measurement probe comprises two pressure recording surfaces and is arranged in the rib in a manner such that the two pressure recording surfaces are connected in each case to a side of the rib for pressure impingement. Thus, in particular, a pressure difference between both sides of the rib may be detected by the measurement probe. The pressure recording surfaces may be designed on or in the surfaces of the rib in a direct manner as a membrane recording pressure. Alternatively, it is also possible merely for openings to be formed in the surfaces of the rib, which are connected via channels to a measurement probe lying further inside or possibly also outside the conduit section.

According to a further preferred embodiment, at least one recess for receiving the measurement probe may be formed in the rib. This allows a measurement probe designed as a separate component, to be inserted into such a recess. Thus the rib and measurement probe may be manufactured separately, but when inserted into the conduit section, may cooperate such that as a whole the flow resistance in the longitudinal direction of the conduit section is minimised. Particularly preferably, the measurement probe is inserted from the outside through an opening into the conduit section, so that a free end of the measurement probe extends into the conduit section. With the previously described design of the rib, the free end of the measurement probe then extends into the recess in the rib. Such an arrangement permits the measurement probe to be easily exchanged from the outside.

Instead of providing a measurement probe which protrudes into the inside of the conduit section or is arranged in the inside of the conduit section, the conduit section may also comprise openings or channels, which lead to the outside and which permit the arrangement of the measurement probe outside the conduit section and the flow path defined by this. In this manner, the flow in the inside of the conduit section is compromised to an even lesser extent, and the assembly or accessibility of the flow sensor may be improved.

The rib arranged in the conduit section preferably has a rounded or triangular cross section transverse to the flow direction. Thus a large stability in the peripheral direction of the conduit section is realised. An optimal leading of the flow along the rib is achieved by way of the rounded design.

Alternatively or additionally, the at least one guidance element may be designed as at least one profile plate which projects inwards from the inner wall of the conduit section and which is orientated transversely to the flow direction of the fluid to be delivered. This means that such a profile plate opposes the flow along the longitudinal axis of the conduit section. Such a profile plate thus represents a certain flow resistance in the conduit section. Such a profile plate in the conduit section ensures that turbulences or eddies may not undesirably propagate in the conduit section in the flow direction in an unhindered manner. The profile plate slows down or prevents a propagation of turbulences which proceed from the impeller and propagate in the longitudinal direction of the conduit section in this, opposite to the flow direction.

The profile plate extends preferably transversely to the rib and further preferably symmetrically to the middle plane of the rib, in the case that a rib is additionally provided, as has been described above. This means that the rib and profile plate cross one another, wherein the rib penetrates the profile plate at its middle line.

Thereby, it is preferable for the profile plate, proceeding from the inner wall of the conduit section, to extend further inwards into the conduit section than the rib. This means that the profile plate projects beyond the upper edge of the rib in the radial direction, seen from the inner wall of the conduit section.

Moreover, it is preferable for the profile plate, proceeding from the inner wall, to be inclined in the flow direction of the fluid to be delivered. In this manner, the flow resistance in the flow direction of the fluid through the conduit section, which forms the profile plate, is reduced. This arrangement is preferably the case when the flow sensor is situated in the suction union. Turbulences, which are caused by the impeller, propagate in the suction union in the longitudinal direction of the suction union opposite to the flow direction. At least one described profile plate may be arranged in the suction union, in order to brake this propagation of turbulences opposite to the flow direction. If the profile plate is inclined in the flow direction, then the flow resistance in the flow direction is reduced, but such a profile plate opposes the propagation of turbulence opposite to the flow direction. The profile plate thus located proximally to the impeller, forms a type of pocket in which such turbulences are damped or retarded.

The at least one profile plate is arranged preferably behind a measurement probe of the sensor in the flow direction of the fluid to be conveyed. This is particularly the case with an arrangement of the sensor in the suction union of the pump assembly. This arrangement has the effect that the profile plate does not compromise the onflow of fluid onto the sensor, since it is only arranged downstream of the sensor. On the other hand, the profile plate may attenuate the propagation of turbulences which are caused by the impeller, opposite to the flow direction, so that these turbulences do not reach the measurement probe or only in a weakened form, so that the disturbances which could adulterate the reading of the sensor are minimised.

In particular, it is preferable to provide several profile plates, which are arranged distanced to one another in the flow direction in the conduit section. An even greater weakening of turbulences or eddies propagating in the conduit section is achieved by way of this. The several profile plates thereby are preferably all designed in an inclined manner in the flow direction, wherein preferably all profile plates have the same inclination angle to the inner wall of the conduit section. A particularly uniform leading of the flow is achieved in the flow direction in this manner.

The flow sensor is preferably arranged on the end of the conduit section, which is distanced to the impeller, wherein an obstruction of the flow sensor is preferably situated at the end of the suction union, which is distanced to the impeller. Thereby, the obstruction may be designed for example in an insert, which is inserted into the suction union from the open end, so that the obstruction is situated at the end of the suction union. Thereby, the insert may also extend in the manner described above, beyond the axial end of the suction union, so that it may enter into a connecting pipe conduit. With this design, it is also possible to arrange the obstruction even further outside the suction union in the insert, so that it is situated in a pipe conduit which borders the suction union. In this manner, one may achieve a greater distance between the obstruction and the impeller, without having to increase the length of the suction union. Alternatively, it is also possible to design the obstruction as one piece with the suction union, or to insert the obstruction in the radial direction through an opening in the wall of the suction union, into the cross section of the suction union. The obstruction thereby extends preferably in the diameter direction through the complete cross section of the suction union. Alternatively, it is also possible to design an obstruction such that it does not extend over the whole cross section of the suction union in the diameter direction, i.e. it has a length in the diameter direction, which is smaller than the inner diameter of the suction union at the position of the obstruction. The opening, into which the obstruction is inserted, may for example be an existing opening for pressure detection, so that such an obstruction may also be inserted into an existing centrifugal pump assembly. The largest possible distance between the obstruction and the impeller is achieved by the position at the axial entry end of the suction union.

According to a special embodiment, a hose-like or tube-like insert may be provided at the free end of the suction union, which is inserted into the suction union, so that it projects into the suction union from the end. Moreover, the insert extends beyond the free end of the suction union in a manner such that it may enter into an adjacent pipe conduit, when the suction union is connected to this pipe conduit. In this manner, an optimised leading of the flow in the transition region or connection region from the pipe conduit to the suction union is achieved by the insert. The insert bears on the inner wall of the suction union and the adjacent pipe conduit. The insert thereby is preferably designed in an elastic manner, so that it may compensate a slight offset between the pipe conduit and the suction union. Otherwise, it bridges the flange or the connection region so that there, edges or undercuts, at which turbulences could arise, are avoided and thus a flow sensor which is applied in the entry region of the suction union, may be subjected to onflow in an as optimal as possible manner.

Figure 2:
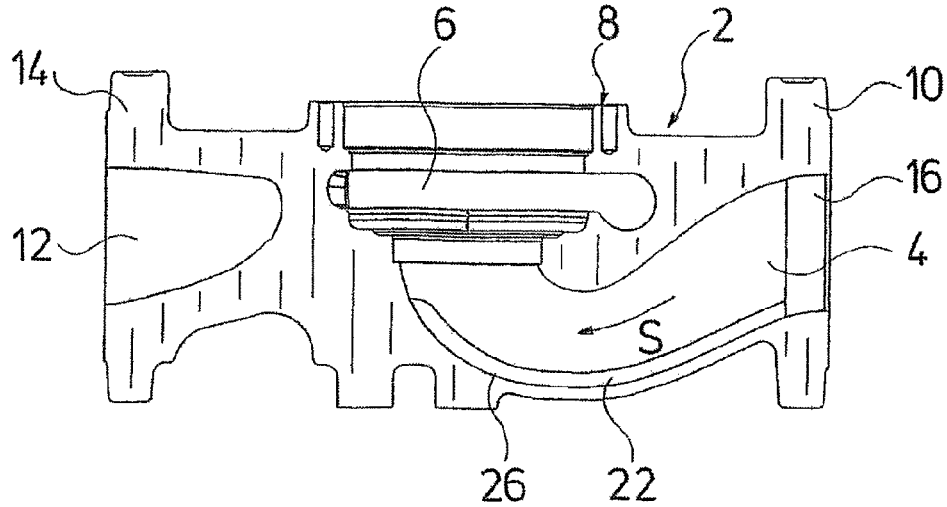
Figure 3:
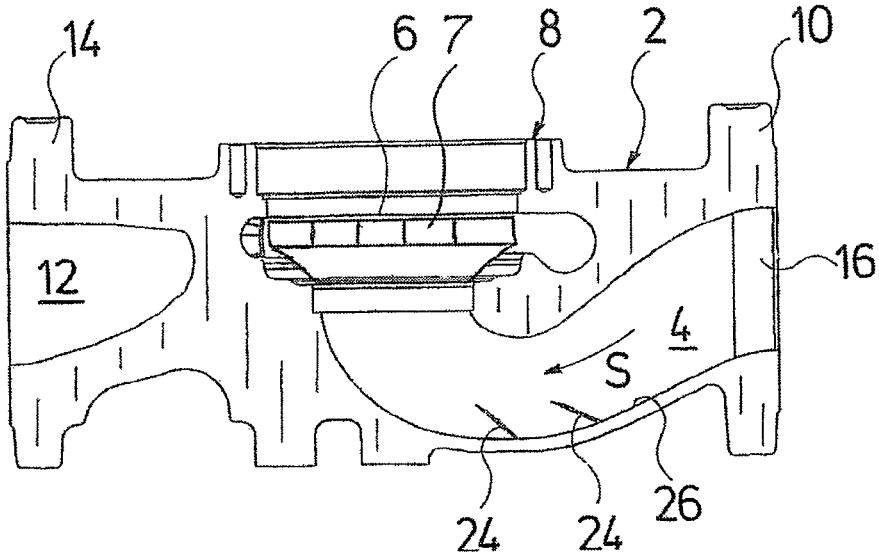
Figure 4:
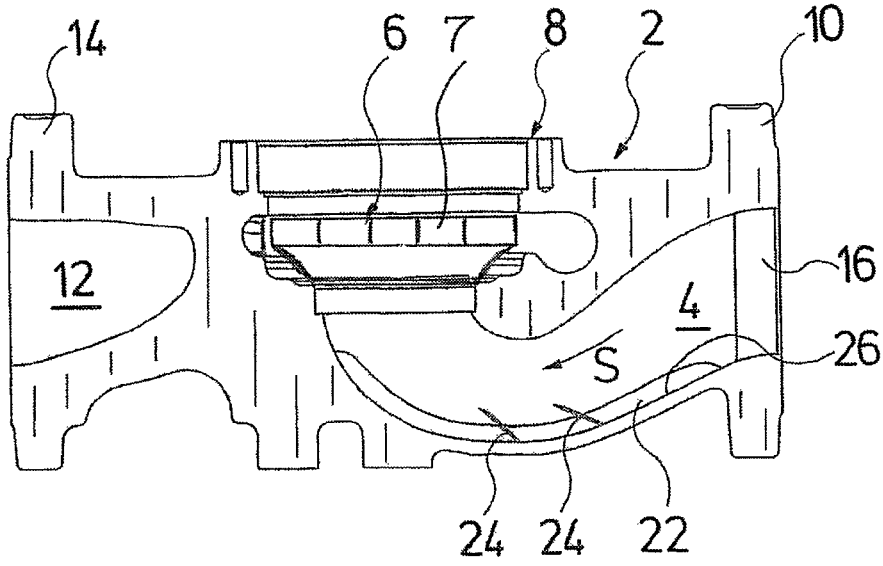
Figure 5:
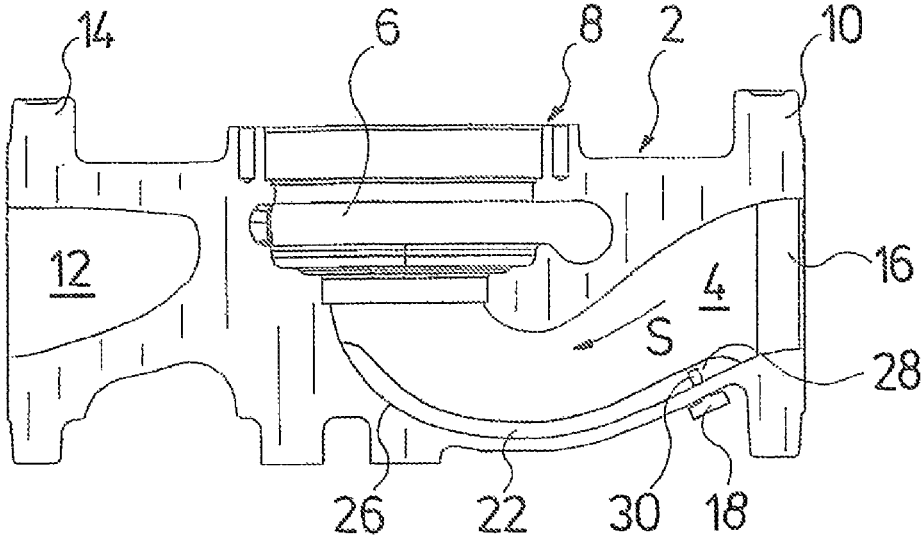
Figure 6:
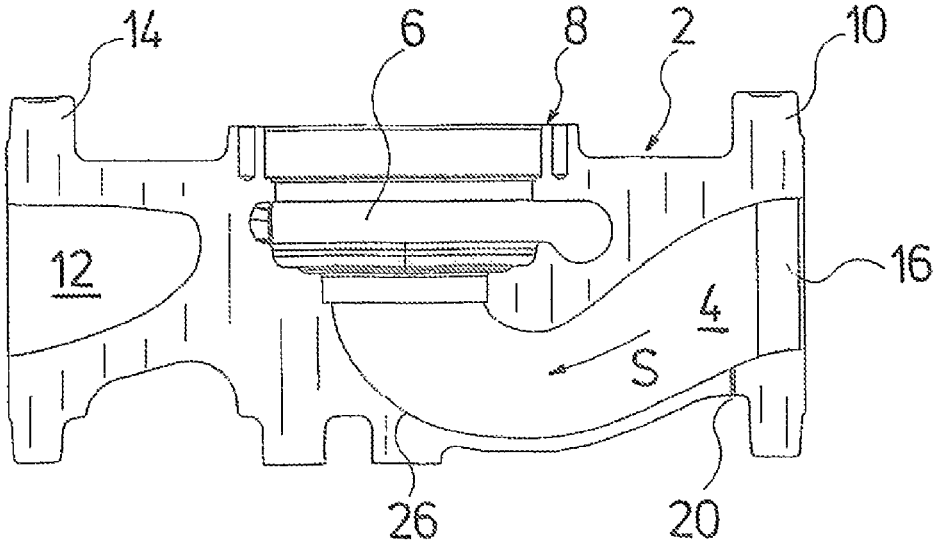
Figure 7:
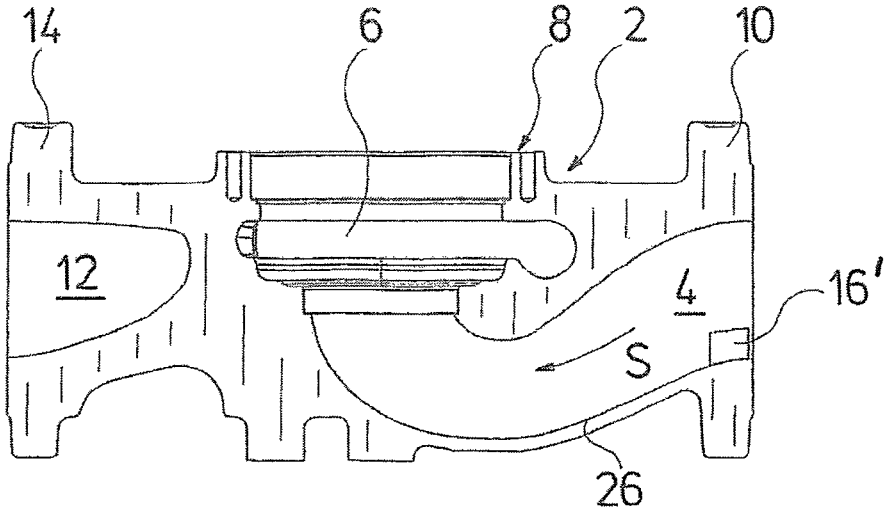
Figure 8:
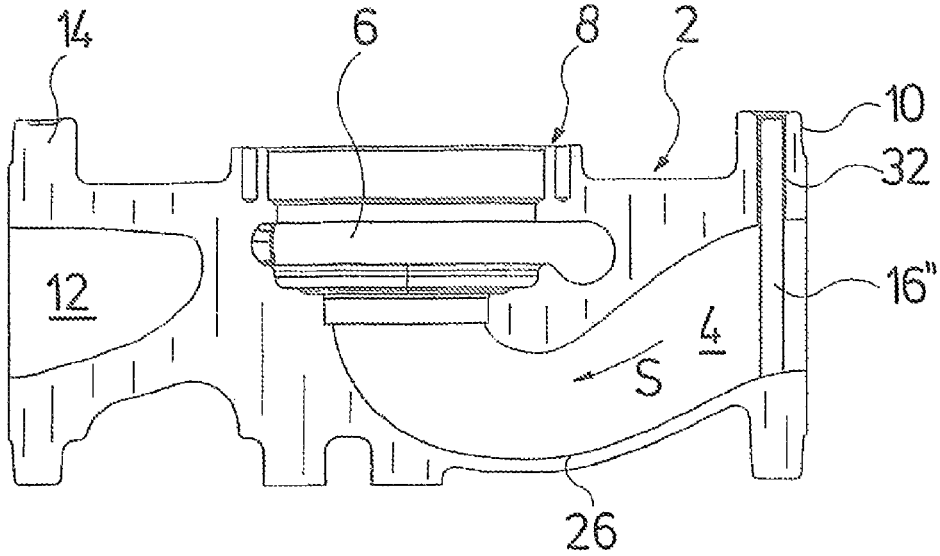
Figure 9:
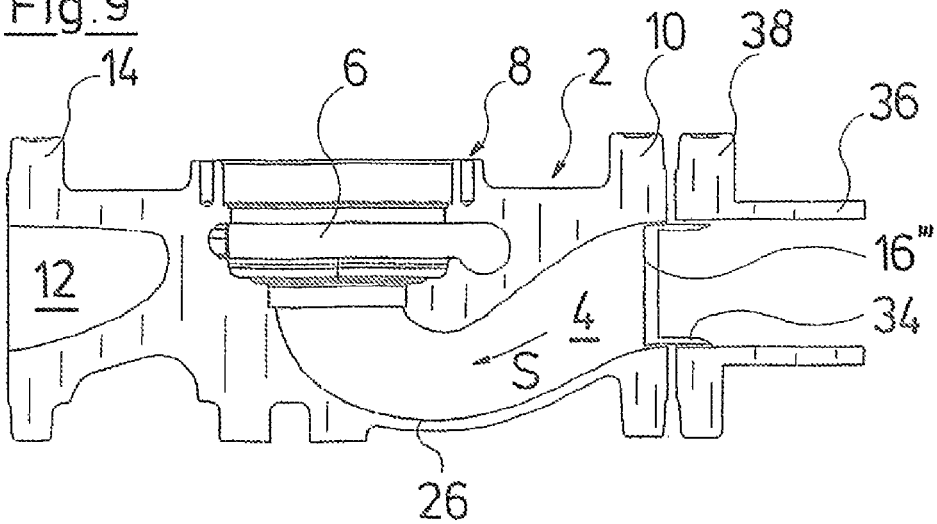

The invention is hereinafter described by way of example and by way of the attached figures. In these there are shown in:

FIG. 1 a cross section through a pump housing, along the middle plane of the suction union, with a rib arranged in the suction union, FIG. 2 a sectioned view according to the view in FIG. 1, with a rib arranged in the suction union, according to a second embodiment, FIG. 3 a cross section through a pump housing along the middle plane of the suction union, with profile plates arranged therein, FIG. 4 a sectioned view according to the view in FIG. 3, wherein a rib is arranged in the suction union, additionally to the profile plates, FIG. 5 a view according to FIG. 1, wherein one possible arrangement of a measurement element is additionally shown, FIG. 6 a sectioned view of a pump housing along the middle plane of the suction union, illustrating a channel formed in the wall of the suction union to create a connection to a measurement element as a second possible arrangement for a measurement element, FIG. 7 a sectioned view of a pump housing along the middle plane of the suction union, with a second embodiment of an obstruction, FIG. 8 a sectioned view of a pump housing along the middle plane of the suction union, with a third embodiment of an obstruction, and FIG. 9 a sectioned view of a pump housing along the middle plane of the suction union, with an adjacent pipe conduit and with an insert inserted in the connection region.

Hereinafter, preferred embodiments of the invention are explained by way of the mentioned figures. Thereby, the same reference numerals are used for identical components in the individual figures, and only the differences are explained in detail. All figures in each case show a sectioned view through a pump housing 2 along the middle plane of the suction union 4. This middle plane extends along the longitudinal axis of the suction union 4, i.e. the flow direction of a fluid to be delivered. The cross section runs further in the diameter direction through the receiver space 6 of the pump housing 2, in which an impeller 7 of the pump, is arranged. A connection flange 8 for connection of a drive motor, is formed on the side of the receiver space 6, which is distant to the suction union 4.

The suction union 4 ends at its axial end which is distant to the receiver space 6 and thus to the impeller, in a flange 10. Accordingly, the pressure union 12 ends in a flange 14, at the diametrically opposite side of the pump housing 2.

According to the invention, a flow sensor is integrated into the pump housing 2, which is designed as a vortex flow sensor, i.e. as a flow sensor which is based on the Karman phenomena of the shedding of vortices. This flow sensor, as an essential element, comprises an obstruction 16 which causes eddies in the flow, whose frequency is detected via a pressure sensor. The frequency of the eddies is proportional to the flow speed.

A first embodiment of such an obstruction 16 is shown in the FIGS. 1 to 6. There, the obstruction is arranged at that axial end of the suction union 4, which is distant to the receiver space 6 and thus to the impeller, i.e. close to or in the flange 10. The obstruction 16 is preferably triangular in cross section (not shown here) and extends in the diameter direction transversely through the suction union 4.

For evaluating the vortices caused by the obstruction 16, either a measurement probe 18 is arranged such that it extends into the suction union 4, as shown in FIG. 5, or a measurement probe may be arranged outside the suction union 4. As is shown in FIG. 6, a channel 20 or, as the case may be, several channels 20 may be provided in the wall of the suction union 4 for such an arrangement, wherein these channels extend outwards from the inner side of the suction union 4 and permit an arrangement of measurement probes on the outer side of the suction union 4. The measurement probes are not shown in the FIGS. 1 to 4 as well as 7 to 9, but it is to be understood that a measurement probe 18 or a channel 20 is arranged in the manner shown in the FIG. 5 or 6, also with these embodiments.

The arrangement of the flow sensor and in particular of the measurement probe 18 in the pump housing 2 entails the problem that the measurement result may be compromised by way of turbulences or vortices, which are caused by the rotating impeller 7 in the receiver space 6. In order to minimise these disturbances, guidance elements are arranged in the conduit section, in which the flow sensor is arranged, here in the suction union 4.

A first such guidance element is shown in FIG. 1. There, a rib 22 is to be seen, which extends radially inwards from the inner wall of the suction union 4. Thereby, the rib 22 extends in the longitudinal direction of the suction union 4 in a web-like manner along the inner wall of the suction union 4. The rib is preferably designed in a rounded or triangular manner in cross section, which is not shown here, so that it permits an optimised leading of the flow in the longitudinal direction of the suction union 4 with an adequate stability. The rib 22 extends in the suction union 4 up to into the curvature region, in which the suction union 4 curves towards the receiver space 6. In the example shown in FIG. 1, the rib 22 begins in the flow direction at a distance behind the obstruction 16. In the embodiment example according to FIG. 2, the rib 22 extends up to the obstruction 16. The rib 22 has the effect that in particular rotary flows or turbulences are damped in the inside of the suction union 4, by which means the measurement result of the flow sensor is improved. Such turbulences may, proceeding from the impeller, propagate in the receiver space 6 opposite to the flow direction S, in the suction union 4, to the flow sensor or its obstruction 16. Such turbulence is minimised by the rib 22.

The FIGS. 3 and 4 show the arrangement of a further possible guidance element in the form of two profile plates 24. The profile plates 24 extend transversely to the flow direction S proceeding from the inner wall of the suction union 4, into the suction union. Thus the profile plates 24 extend in a direction transversely to the extension direction of the rib 22 explained by way of FIGS. 1 to 2. In the embodiments examples shown here, two profile plates 24 are provided distanced to one another in the flow direction S. The profile plates 24 extend at an angle to the inner wall 26 of the suction union 4. Thereby, both profile plates 24 extend essentially at the same angle to the inner wall 26. The inclination of the profile plates 24 is selected such that they are inclined in the flow direction S, i.e. they distance themselves further and further from the inner wall 26 in the flow direction S, proceeding from the inner wall 26. The profile plates 24 serve for preventing or damping a propagation of turbulences or vortices opposite to the flow direction S, proceeding from the impeller, which is arranged in the receiver space 6, so that the flow is calmed in the region of the flow sensor, i.e. of the obstruction 16 and of the measurement probe 18 or of the channel 20, and thus the measurement result is not compromised by the turbulences caused by the impeller. Thus the profile plates 24 are arranged in the flow direction between the measurement probe 18 or the channel 20, and the receiver space 6.

FIG. 4 shows a combination of the profile plates 24 with the previously described rib 22. Thereby, the rib 22 intersects the profile plates 24 normally to the surface of the profile plates 24. The profile plates 24 are preferably designed such that they are symmetrical to the middle plane of the rib 22. Proceeding from the inner wall 26, the profile plates 24 extend further than the rib 22, into the inside of the suction union 4.

Although two profile plates 24 are shown in the example shown here, it is to be understood however that the invention is not limited to the arrangement of two such profile plates, and also merely one profile plate 24 or also more than two profile plates 24 may be arranged. It is also to be understood that the rib 22 with the embodiment example according to FIG. 4, may be designed according to the design in FIG. 2.

As shown in FIG. 5, the measurement probe 18 may be inserted from the outside through the wall of the suction union 4, such that its free end 28 projects into the inside of the suction union 4. Pressure recording surfaces or pressure recording regions 30 are present at the free end of the measuring probe 28, via which the pressures or pressure changes caused by the vortices in the inside of the suction union 4 are recorded. Thereby, in each case, pressure recording surfaces are formed preferably at two opposite sides of the free end 28, so that the pressures at two sides of the measurement probe 18 may be detected. The measurement probe 18, with its free end 28, is thereby arranged in the rib 22, such that its two sides with their respective pressure recording surfaces 30, in each case face one of the sides of the rib 22, or are directed to one of the sides of the rib 22. A suitable receiver for the free end of the pressure sensor 18, into which this engages preferably in a fitting manner, is formed in the rib 22, so that the free end 28 of the measurement probe 18 is situated in the inside of the rib 22 and thus the flow in the inside of the suction union 4 is compromised as little as possible in the flow direction S.

An alternative arrangement for a measurement probe is shown in FIG. 6, wherein the measuring probe itself is not shown. A channel 20 or several channels 20 which create a connection to a measurement probe situated outside of the suction union 4, may be formed in the wall of the suction union 4. Thereby, it is to be understood that with the embodiment example according to FIG. 6, a rib 22 and/or profile plates 24 are likewise arranged corresponding to FIGS. 1 to 5, which are not shown here for the sake of simplicity. In the case of the arrangement of a rib 22, the channel 20 may extend into the rib 22 and preferably be opened to one or both side walls of the rib 22. Particularly preferably, two channels 20 are provided, of which each is opened to a side wall of the rib 22. The channels 20 are then in connection with pressure recording surfaces of one or more measurement probes, outside the suction union 4.

Hereinafter, three further possible designs of an obstruction 16 are explained by way of FIGS. 7 to 9.

With the embodiment according to FIG. 7, the obstruction 16' is arranged similar to the obstruction 16 according to the FIGS. 1 to 6, but does not extend over the whole diameter of the suction union 4, but proceeding from the inner wall 26, projects into the inside of the suction union 4 only by a length which is smaller than the inner diameter of the suction union 4. Thereby, the obstruction is preferably situated in the peripheral region, in which a measurement probe is also situated. The remaining design corresponds to the previous description. In particular, it is to be understood that guidance elements such as the rib 22 and/or profile plates 24 are also arranged with the embodiment according to FIG. 7, but are not shown in FIG. 7. The same applies to the arrangement of the measurement probe 18 or the channel 20. This is also provided with regard to the embodiment according to FIG. 7, but is not shown in FIG. 7.

With the embodiment according to FIG. 8, the obstruction 16" is designed in a rod-like manner and extends in the diameter direction completely through the suction union 4 from the one side of the inner wall 26 to the opposite side of the inner wall 25. The obstruction 16" in cross section is designed in a preferably triangular manner, as with the obstruction 16 and 16'. The obstruction 16" is inserted from the outside through a hole 32 into the suction union 4. The hole 32 extends in the flange 10 from the outer periphery into the inside of the suction union 4. Such a hole may be provided for a pressure sensor for example, with conventional pump assemblies, and also for receiving an obstruction 16". The hole 32 permits a simple insertion and exchange of the obstruction 16" from the outside. Moreover, conventional pumps which comprise such a hole 32, may be provided with such an obstruction 16" at a later stage.

With regard to the embodiment according to FIG. 9, the obstruction 16''' is designed as part of an insert 34. The insert 34 is inserted from the open end into the suction union 4, in a manner such that it extends outwards beyond the end of the flange 10 and into a connecting pipe conduit 36, which is connected to the flange 10 via a counter flange 38. The insert 34 is designed in an essentially tubular manner, and the obstruction 16''' extends in a rod-like manner in the diameter direction from one side to the diametrical opposite side of the insert 34. The obstruction 16''' is designed in cross section just as described previously by way of the obstruction 16, 16' and 16". The peripheral wall of the insert 34 bridges the connection region between the flanges 10 and 38 and a gap which, as the case may be, is located between these. In this manner, one achieves an improved leading of the flow in the transition between the pipe conduit 36 and the suction union 4, since no vortices occur in the region, in which the flanges 10 and 38 bear on one another. The peripheral wall of the insert 34 may be designed such that it comes to bear snugly on the inner peripheries of the suction union 4 and the pipe conduit 36, so that it forms no edges or likewise there, at which vortices of the flow may occur. For this, the edges are preferably optimised in a manner which is favourable with regard to the flow, i.e. rounded for example. Moreover, the peripheral walls of the insert 34 may preferably be designed elastically, so that a sealing bearing on the inner periphery of the suction union 4 and the pipe conduit 36 is ensured, in particular in the case that a slight offset between the suction union 4 and the pipe conduit 36 should occur. Thus also with such an offset, one may create a smooth flow path between the pipe conduit 36 and the suction union 4 without larger edges and steps.

With regard to the embodiment examples according to FIGS. 8 and 9, it is to be understood that guidance elements such as rib 22 and/or the profile plates 24, as have been previously described, are also provided with these, but these have not been shown in the FIGS. 8 and 9 for the sake of simplicity. The arrangement of the measurement probe is also envisaged with these embodiment examples, as is explained by way of FIGS. 5 and 6.

With the embodiment according to FIG. 9, it is also conceivable to arrange the obstruction 16''' in the insert 34, such that the obstruction 16''' is not situated in the suction conduit 4, but in the connecting pipe conduit 36. In this manner, one may create an even greater distance between the obstruction 16''' and the receiver space 6 or the impeller which is arranged therein.

The guidance elements for influencing the flow, as shown in the figures, are favourably arranged on the side of the inner wall 26 of the suction union 4, which is concavely curved towards the receiver space 6 or has the largest radius of curvature. A more favourable influencing of the flow and damping of undesired vortices or turbulences may be achieved in this region.

In the shown and described examples, the flow sensor is situated in the suction union 4. It could however also be arranged in a corresponding manner in the pressure union 12, wherein then a rib 22 and/or profile plates 24 are arranged in a corresponding manner in the pressure union 12.

LIST OF REFERENCE NUMERALS

2—pump housing
4—suction union
6—receiver space
8—connection flange
10—flange
12—pressure union
14—flange
16, 16', 16'', 16'''—obstruction
18—measurement probe
20—channel
22—rib
24—profile plate
26—inner wall
28—free end of the measurement probe
30—pressure recording surfaces
32—hole
34—insert
36—pipe conduit
38—counter flange
S—flow direction

The invention claimed is:

1. A centrifugal pump assembly with at least one impeller, a suction union (4) on an entry side of the at least one impeller, a pressure union (12) on an exit side of the at least one impeller, and a vortex flow sensor and at least one guidance element (22, 24) in a conduit section formed by the suction union (4) or the pressure union (12), wherein said at least one guidance element is a rib (22) projecting radially inwardly from an inner wall (26) of the conduit section and at least one profile plate (24) which projects inwardly from the inner wall (26) of the conduit section and extends transversely to the rib (22), and which is orientated transversely to a flow direction (S) of a fluid to be delivered by the pump, and wherein said at least one guidance element influences a flow in the conduit section such that disturbing turbulences which compromise measurements of the vortex flow sensor are kept away from the sensor.

2. The centrifugal pump assembly according to claim 1, wherein the at least one guidance element (22, 24) is suitable for calming the flow in the conduit section.

3. The centrifugal pump assembly according to claim 1, wherein the rib (22) extends in the flow direction (S) of the fluid to be delivered along the inner wall (26) of the conduit section.

4. The centrifugal pump assembly according to claim 1, wherein a measurement probe (18) of the flow sensor is arranged in the rib (22).

5. The centrifugal pump assembly according to claim 4, wherein the measurement probe (18) comprises two pressure recording surfaces (30) and is arranged in the rib (22) such that each of the two pressure recording surfaces (30) are connected to one side of the rib (22) for pressure impingement.

6. The centrifugal pump assembly according to claim 4, wherein at least one recess for receiving the measurement probe (18) is formed in the rib (22).

7. The centrifugal pump assembly according to claim 1, wherein the at least one profile plate (24), proceeding from the inner wall (26), extends further inwardly into the conduit section than the rib (22).

8. The centrifugal pump assembly according to claim 1, wherein the flow sensor is at an end of the conduit section, which is spaced from the impeller.

9. The centrifugal pump assembly according to claim 8, wherein an obstruction (16, 16', 16'', 16''') of the flow sensor is situated at an end of the suction union (4), which is spaced from the impeller.

10. The centrifugal pump assembly according to claim 1 wherein the at least one profile plate (24) is designed symmetrical to a middle plane of the rib (22).

11. A centrifugal pump assembly with at least one impeller, a suction union (4) on an entry side of the at least one impeller, a pressure union (12) on an exit side of the at least one impeller, and a vortex flow sensor and at least one guidance element (22, 24) in a conduit section formed by the suction union (4) or the pressure union (12), wherein said at least one guidance element is at least one a profile plate (24) which projects inwardly from the inner wall (26) of the conduit section and which is orientated transversely to a flow direction (S) of a fluid to be delivered by the pump, and is inclined in the flow direction (S), and wherein said at least one guidance element influences a flow in the conduit section such that disturbing turbulences which compromise measurements of the vortex flow sensor are kept away from the sensor.

12. A centrifugal pump assembly with at least one impeller, a suction union (4) on an entry side of the at least one impeller, a pressure union (12) on an exit side of the at least one impeller, and a vortex flow sensor and at least one guidance element (22, 24) in a conduit section formed by the suction union (4) or the pressure union (12), wherein said at least one guidance element is at least one profile plate (24) which projects inwardly from the inner wall (26) of the conduit section and which is orientated transversely to a flow direction (S) of a fluid to be delivered by the pump, and is located behind a measurement probe (18, 20) of the sensor in the flow direction (S), and wherein said at least one guidance element influences a flow in the conduit section such that disturbing turbulences which compromise measurements of the vortex flow sensor are kept away from the sensor.

13. A centrifugal pump assembly with at least one impeller, a suction union (4) on an entry side of the at least one impeller, a pressure union (12) on an exit side of the at least one impeller, and a vortex flow sensor and a plurality of guidance elements (22, 24) in a conduit section formed by the suction union (4) or the pressure union (12), wherein each guidance element is a profile plate (24) projecting inwardly from the inner wall (26) of the conduit section, orientated transversely to a flow direction (S) of a fluid to be delivered by the pump, and spaced from one another in the flow direction (S), and wherein said guidance elements influence a flow in the conduit section such that disturbing turbulences which compromise measurements of the vortex flow sensor are kept away from the sensor.

14. A centrifugal pump assembly with at least one impeller, a suction union (4) on an entry side of the at least one impeller, a pressure union (12) on an exit side of the at least one impeller, and a vortex flow sensor and at least one guidance element (22, 24) in a conduit section formed by the suction union (4) or the pressure union (12), an insert (34) at a free end of the suction union (4), and extending beyond the free end of the suction union (4) such that said insert (34) may enter into an adjacent pipe conduit (36) to effect an optimized leading of the flow in a connection region of the pipe conduit (36) and the suction union (4), wherein said at least one guidance element is one of:

(i) a rib (22) projecting radially inwardly from an inner wall (26) of the conduit section, (ii) an at least one profile plate (24) which projects inwardly from the inner wall (26) of the conduit section and which is orientated transversely to a flow direction (S) of a fluid to be delivered by the pump, or (iii) a rib (22) projecting radially inwardly from an inner wall (26) of the conduit section and an at least one profile plate (24) which projects inwardly from the inner wall (26) of the conduit section and which is orientated transversely to a flow direction (S) of a fluid to be delivered by the pump, and wherein said at least one guidance element influences a flow in the conduit section such that disturbing turbulences which compromise measurements of the vortex flow sensor are kept away from the sensor.

* * * * *